US005383603A

United States Patent [19]

Englhard et al.

[11] Patent Number: 5,383,603

[45] Date of Patent: Jan. 24, 1995

[54] ASPIRATION-TYPE SPRAYER

[75] Inventors: Ronald F. Englhard, Mission Viejo; Donald J. Shanklin, Fullerton, both of Calif.

[73] Assignee: Hayes Products L.P., Santa Fe Springs, Calif.

[21] Appl. No.: 80,326

[22] Filed: Jun. 22, 1993

[51] Int. Cl.[6] ..... B05B 7/30

[52] U.S. Cl. ..... 239/314; 239/318; 239/586; 222/484; 251/324

[58] Field of Search ..... 239/318, 314, 310, 586; 222/484; 251/319, 324, 284; 137/606

[56] References Cited

U.S. PATENT DOCUMENTS

| | | | |
|---|---|---|---|
| 2,509,671 | 5/1950 | Christensen | 251/324 |
| 2,605,938 | 8/1952 | Balcar . | |
| 2,623,662 | 12/1952 | Balcar . | |
| 2,837,374 | 6/1958 | Lipman | 222/484 |
| 3,186,643 | 6/1965 | George et al. | 239/318 |
| 3,770,205 | 11/1973 | Proctor et al. | 239/318 |
| 3,897,006 | 7/1975 | Tada | 239/333 |
| 4,583,688 | 4/1986 | Crapser | 239/318 |
| 4,653,691 | 3/1987 | Grime | 239/318 |
| 4,676,437 | 6/1987 | Brown | 239/414 |
| 4,750,674 | 6/1988 | Chow et al. | 239/318 |
| 4,767,058 | 8/1988 | LaRosa et al. | 239/318 |
| 5,007,588 | 4/1991 | Chow et al. | 239/318 |
| 5,039,016 | 8/1991 | Gunzel, Jr. et al. | 239/318 |
| 5,064,168 | 11/1991 | Raines et al. | 251/324 |
| 5,100,059 | 3/1992 | Englhard et al. | 239/318 |

*Primary Examiner*—Karen B. Merritt
*Attorney, Agent, or Firm*—Harold L. Jackson

[57] ABSTRACT

An aspiration-type chemical sprayer for dispensing small quantities of a liquid based chemical into a stream of carrier fluid is disclosed. The sprayer includes a sprayer head assembly sealingly mounted onto a container holding chemicals such as pesticides or fertilizers. A carrier fluid control valve in the sprayer head assembly controls carrier fluid flow from a pressurized source of water past an aspiration orifice which forms the terminal end of an aspiration passageway in communication with the chemical within the container. A rod valve connects the aspiration orifice to the aspiration passageway and the container interior to atmospheric pressure when slid into an open position while providing simultaneous closure of the aspiration and vent passageways so as to seal the chemical in the container when slid into a closed position. The rod valve includes a pair of spaced annular integral sealing ridges and is molded in one piece of a plastic material. The ends of the rod valve do not extend beyond the ends of the bore so as to render the sprayer child resistant.

10 Claims, 2 Drawing Sheets

FIG. 1
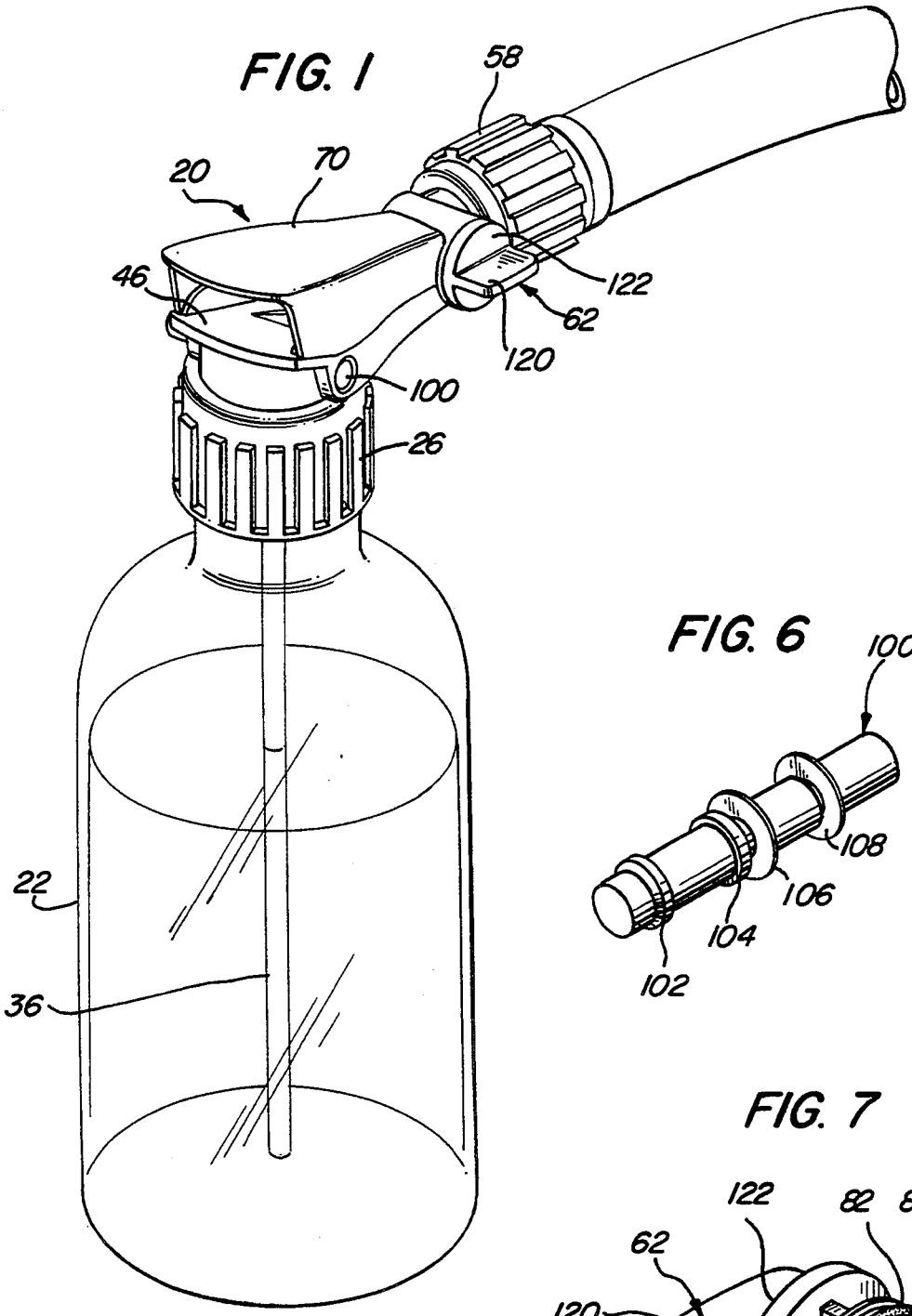
FIG. 6
FIG. 7
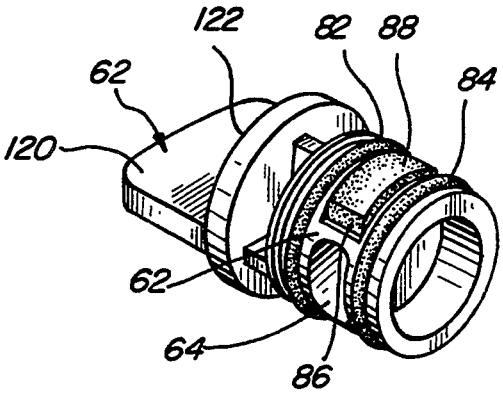

ASPIRATION-TYPE SPRAYER

BACKGROUND OF THE INVENTION

1. Field of the Invention

The invention relates generally to sprayers and more particularly to aspiration-type sprayers for dispensing lawn and garden chemicals.

2. Description of Related Art

Aspiration-type sprayers are used to mix and dispense small quantities of a liquid based chemical into a relatively large carrier fluid such as water. The chemical may be liquid fertilizers or pesticides which are to be applied to crops, plants, lawns, flowers, vegetable gardens and other organic type vegetation. The chemicals are sold to the consumer in concentrated form and must be mixed in a proper proportion with a carrier fluid such as water before being applied to the crops etc. Such concentration chemicals may be hazardous to the consumer end user and environment in general. These chemicals are generally sold in plastic containers. Typically, an aspiration-type sprayer is coupled to the threaded neck of the plastic container and a water hose is coupled to the sprayer. The water hose shoots water through the sprayer which mixes with small quantities of the chemical drawn up from the container forming together a mixed stream. The mixed stream can be focused on the desired target to be chemically treated.

Several aspiration-type sprayers structures have evolved over the years. For example, U.S. Pat. No. 4,750,674 issued to Chow et al, discloses a sprayer having a system of air vent and aspiration openings of different sizes to obtain a selection of discrete mixing ratios. The mechanism requires a system of cups to block openings associated with nonselected aspiration rates and to provide the desired fluid communication. Such a system, however, requires the alignment and assembly of a plurality of elements including openings, cup seal and springs. Such a system is complicated to manufacture and assemble and therefore is undesirably expensive. Further, such devices fail to provide a simplified sprayer with a minimum of parts that are of simple design to promote reliability.

Other conventional sprayers, such as that described in U.S. Pat. No. 3,186,643 issued to George et al use a rotating carrier fluid valve having a range of adjustable carrier fluid flows in combination with a vent bore closure boss extending from the rotating valve. George et al's sprayer arrangement, however, like other conventional sprayers, disadvantageously has many parts which makes it an undesirable alternative for a low cost disposable type sprayer.

U.S. Pat. No. 2,837,374 to E. Lipman is not directed to a hose-end sprayer but to an atomizer cap for perfume bottles. While the Lipman patent illustrates the use of a slide plunger for connecting a liquid tube (extending within the perfume bottle) to an atomizing channel and a vent hole to atmosphere or for blocking both the liquid tube and vent hole it does not disclose any means for controlling the flow of pressurized carrier liquid such as water. Moreover, Lipman relies on O-rings for providing a seal between the slide plunger and a cooperating bore in the cap. The use of such O-rings in a low pressure environment adds to the manufacturing costs of the unit.

An improved aspiration-type sprayer is disclosed in U.S. Pat. No. 5,039,016 issued to Ronald Englhard and Donald Shanklin, the inventors of the present invention, which includes a sprayer head assembly sealingly mounted onto a container for storing a chemical to be dispensed. The sprayer head includes a multi-function unitary valve providing an aspiration opening simultaneously with full communication of the container interior to atmospheric pressure. The valve may include means for positive and simultaneous closure of the aspiration and vent passages so as to seal the chemical in the container when the sprayer is not in use. The sprayer assembly is coupled to a source of pressurized carrier fluid such as a garden hose. The carrier fluid is controlled by a control valve which blocks the flow of water from the hose when the sprayer is not in use.

Another improved aspiration-type sprayer is disclosed in U.S. Pat. No. 5,100,059 also issued to the inventors herein, Englhard et al, which discloses a sprayer having a unitary valve in the sprayer head assembly which controls carrier fluid flow from a pressurized source of water while simultaneously providing a controlled aspiration rate and full communication of the container interior to atmospheric pressure. The valve additionally includes simultaneous closure of the carrier fluid, aspiration and vent passageways so as to seal the chemical in the container when the sprayer is not being used. While the two afore-described aspiration-type sprayers provide many advantages over other sprayers, a simple arrangement that can be readily reproduced would be an advancement to the art.

SUMMARY OF THE INVENTION

It is therefore an object of the invention to provide an aspiration type sprayer which components are of relatively simple structure such that they can be easily manufactured and assembled.

It is another object of the invention to provide an aspiration type sprayer with a simple yet positive means to open and close the chemical to and from the atmosphere.

It is another object of the invention to provide an aspiration-type sprayer with a child resistant chemical dispensing valve.

A two valve aspiration-type sprayer according to the present invention includes a sprayer head assembly that is attached to a container for storing chemicals therein. A hose may be connected to the sprayer head assembly to provide the necessary carrier fluid, which typically is water. The sprayer head assembly has a rotatable valve positioned therein for controlling carrier fluid flow through the sprayer head assembly. A rod valve including, for example, integrally formed sealing ridges, is transversely disposed through the sprayer head assembly for simultaneously controlling the eduction of the chemical from the container and venting the container to atmosphere. By a simple push of the rod valve, the container can be opened for a spray operation or closed and sealed off to protect the environment from any unwanted chemical exposure.

Other and further objects, advantages and characteristic features of the present invention will become readily apparent from the following detailed description of a preferred embodiment of the invention when taken in conjunction with the accompanying drawings.

BRIEF DESCRIPTION OF THE DRAWINGS

FIG. 1 is a perspective view of a sprayer head assembly attached to a chemical container according to the principles of the invention;

FIG. 6 is a perspective view of the rod valve used in this particular embodiment of invention; and FIG. 7 is a perspective view of a carrier fluid control valve according to the principles of the invention.

DESCRIPTION OF THE PREFERRED EMBODIMENTS

Figure 2:
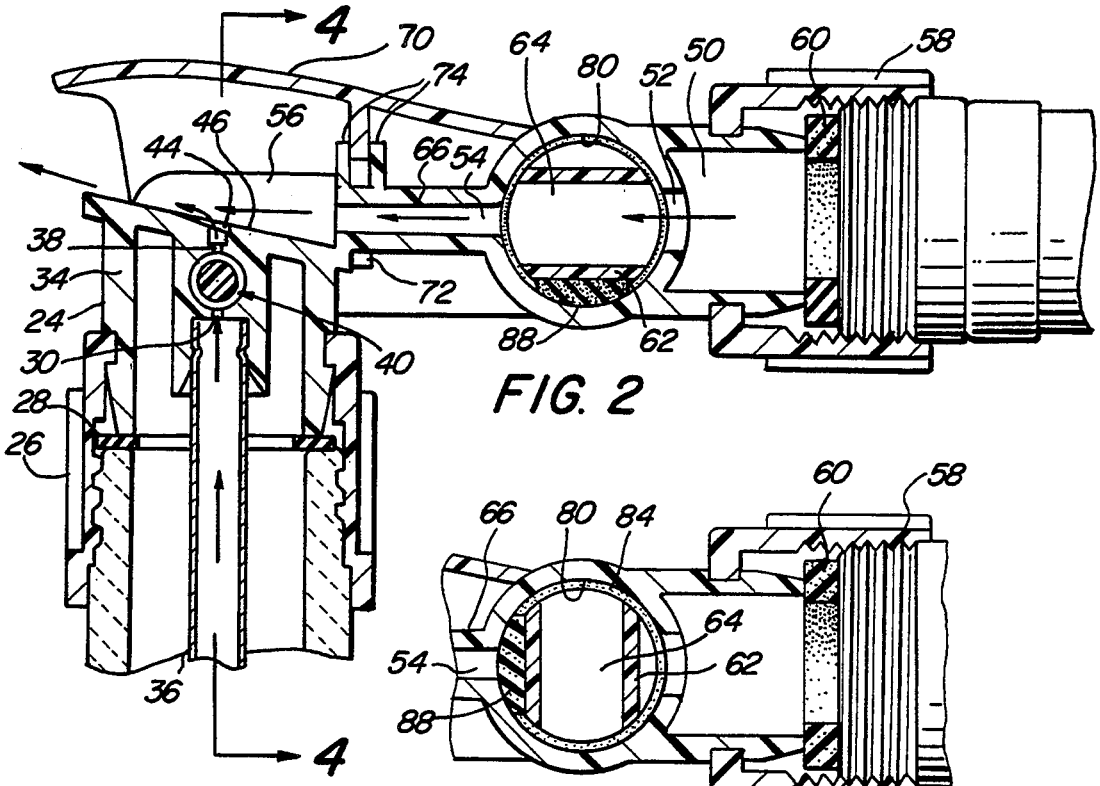
FIG. 2 is a partially broken away cross-sectional side view of the sprayer head assembly of FIG. 1.
Figure 3:
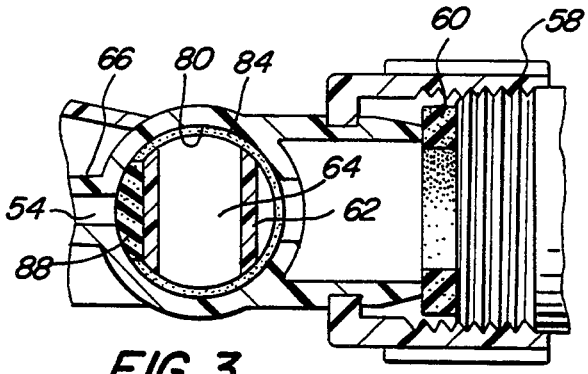
FIG. 3 is a partial side view of the sprayer head assembly of FIG. 2 wherein the carrier fluid control valve is shown in its closed position.

Referring now with more particularity to the drawings, wherein like or similar parts are designated by the same numerals throughout the various figures, a sprayer head assembly 20 is illustrated in FIGS. 1–5 which sealingly is secured to the mouth of a chemical container 22. The connection between the sprayer head assembly 20 and container 22 can be achieved by providing the depending sprayer neck portion 24 with a conventional rotatable coupler 26 including washer 28, the rotatable coupler having internal threads which cooperatively receive corresponding threads surrounding the mouth of a container bottle, such as container 22. To make the sprayer head assembly 20 nonremovable from the container neck, the sprayer neck may include inwardly projecting lugs which oppose cooperating lugs (not shown) formed on the container, thereby preventing removal of the sprayer head assembly following installation onto a chemically filled container. When installed to the sprayer head assembly 20, the mouth of container 22 is in communication with upstream aspiration passageway or duct 30 and upstream vent duct 32 open into transverse hole 40. An aspiration orifice 38 is formed in sprayer head body 34 on the opposite side of transverse hole 40 from upstream aspiration duct 30. The aspiration orifice opens into a graduated recess 44 formed on upwardly inclined wall 46 of sprayer head body 34.

The sprayer head assembly 20 includes a fluid carrier means which includes an inlet carrier fluid passageway comprising an input chamber 50, a first constricted carrier fluid hole 52 and a second constricted carrier fluid hole 54. The fluid carrier means further includes an expansion chamber 56 serving as the outlet. The upstream end of inlet fluid carrier means includes a conventional rotatable coupler 58 including washer 60, for threaded sealing engagement between input chamber 50 and a source of pressurized carrier fluid, such as a garden hose, for example. The carrier fluid is received in input chamber 50 and controlled through first constricted hole 52 by means of carrier fluid control valve 62 which has a carrier fluid valve hole 64 traversely therethrough. The carrier fluid control valve 62 may be rotated to align carrier fluid valve hole 64 with first and second constricted holes 52 and 54 for discharge of carrier fluid into expansion chamber 56. Second constricted hole 54 preferably is an elongated bore type hole extending through tube portion 66, as shown more particularly in FIG. 2, which provides a high velocity stream of carrier fluid into expansion chamber 56 and past the graduated recess 44 and aspiration orifice 38. Expansion chamber 56 is covered with hood 70 which is snapped over and onto sprayer head body 34. Hood 70 has two opposed downwardly depending prongs 72 which are fitted between parallel walls 74 and snap over tube portion 66.

Carrier fluid control valve 62 is constructed to define a cylindrical periphery for sliding engagement with the interior wall of transverse bore 80 in sprayer head body 34. The valve outer periphery has two O-rings 82 and 84 shown in FIG. 7 which rest in circumferential grooves. The carrier fluid control valve 62 is inserted into transverse bore 80 so as to position carrier fluid valve hole 64 along the line of first and second constricted carrier fluid holes 52 and 54. The O-rings 82 and 84 engage the cylindrical wall of bore 80 so as to sealingly partition the carrier fluid valve hole 64 within bore 80. The carrier fluid control valve 62 has formed therein a recessed area 86 which retains stopper member 88. Stopper member 88 sealingly engages the cylindrical wall of bore 80 as shown more particularly in FIGS. 2 and 3, and when it is in registry with the second constricted carrier fluid hole 54 by rotating control valve 62 to its closed position, carrier fluid flow is prevented.

Figure 4:
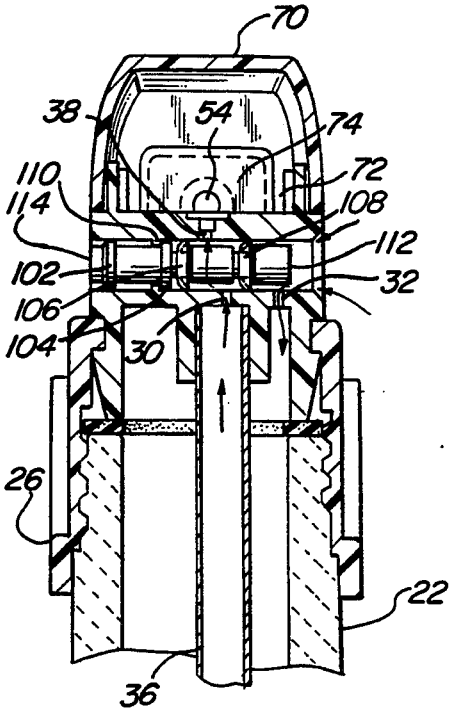
FIG. 4 is a sectional view taken along line 4—4 of FIG. 2 showing the rod valve in the open position.
Figure 5:
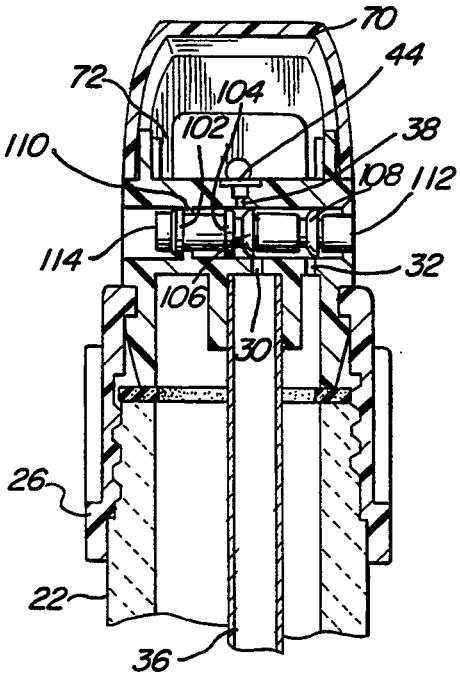
FIG. 5 is the section view of FIG. 4 shown with the rod valve in its closed position.

Chemical fluid flow and venting of the container 22 is controlled by rod valve 100 positioned within transverse bore 40. First and second positioning members 102 and 104, which are preferably annular rectangularly shaped protrusions, slideably engage the inner wall of transverse hole 40. First and second annular sealing ridges 106 and 108 sealingly engage the inner wall of transverse bore 40. A stopping member 110 preferably circumscribes the inner wall of transverse bore 40 as an annular rectangularly shaped protrusion. Rod valve 100 is positioned within transverse hole 40 such that annular stopping member 110 is stationed between the two annular positioning members 102 and 104. Furthermore, the annular sealing ridges are positioned along the extent of rod valve 100 such that when one end 112 thereof is pushed in (open position) the second annular sealing ridge 108 will be positioned with the upstream aspiration duct 30 and aspiration orifice 38 on one side and vent duct 32 on the other side thereof. In this open position the first annular sealing ridge 106 will sit outside of these ducts as shown in FIG. 4. Accordingly, vent duct 32 will be open to the atmosphere and upstream aspiration duct 30 will be in open registry with the aspiration orifice 38 in the sprayer head body 34. Thus, communication of the chemical contents of container 22 is possible at a flow rate which is controlled by the sizes of the aspiration orifice 38 and the carrier fluid bore 54 (over a relatively wide range of carrier fluid pressures). The size of the aspiration orifice 38 and the bore 54 are preselected based upon typical carrier fluid pressures to yield a desired mixing ratio of chemical to carrier fluid. When the other end 114 of rod valve 100 is pushed in (closed position), annular sealing ridges 106 and 108 sit outside of the upstream aspiration duct 30 and vent duct 32, but inside of the aspiration orifice 38, as shown in FIG. 5. Accordingly, vent duct 32 and the chemical in the container 22 are cut off from the atmosphere and the upstream aspiration duct 30 is sealed off from the aspiration orifice 38.

It should be noted that neither end of the rod valve 100 extends beyond the ends of the bore 40 regardless of the position of the valve to change the position of rod valve 100, for example from a closed to an open position, it is necessary to use a small instrument such as a screwdriver or awl to move the rod 100 lengthwise along the bore 40. This feature renders the sprayer child resistant.

The sprayer head assembly including the rod valve 100 may be made of a suitable plastic material, e.g., polypropylene or polyethylene. The separate pieces of the assembly are preferably injection molded. The formation of the sealing ridges 106 and 108 integrally with the rod valve 100 reduces the manufacturing and assembly cost over the use of separate sealing members such as O-rings.

In operation, when the carrier fluid control valve 62 is rotated in the open position by turning wing 120 on valve cap 122, a stream of pressurized fluid is discharged through the second constricted hole 54 into the hooded expansion chamber 56 and over the graduated recess 44 and aspiration orifice 38. This high velocity stream results in a zone of reduced pressure inside the graduated recess 44. As shown in FIG. 2, if the rod valve is in its open position, the suction created by the low pressure in graduated recess 44 draws the chemical solution in the container through dip tube 36, upstream aspiration duct 30, aspiration orifice 38, and into the stream of the carrier fluid. Venting is provided through vent duct 32. The carrier fluid control valve and rod valve can conveniently be operated with one hand while the sprayer nozzle, chemical container and water hose can be controlled with the other thereby providing a safe spray operation.

Although the dispensing closure may be made of any suitable material, flexible synthetic plastic material is preferred such as polypropylene which is particularly suitable for constructing the sprayer head assembly 20 since it is resilient yet durable. However, any other material which is resistant to and compatible with the chemical fluid to be sprayed or other matter to be held in the container may also be used as a material for manufacturing the sprayer head assembly. The stopper member 88 is preferably made of a soft plastic elastomer material or other suitable synthetic rubber material. Such material provides an effective seal with the bore surface which is typically made of a harder synthetic plastic material.

The above-described detailed description of a preferred embodiment described the best mode contemplated by the inventors for carrying out the present invention at the time this application was filed and is offered by way of example and not by way of limitation. Accordingly, various modifications may be made to the above-described preferred embodiment without departing from the scope of the invention. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What is claimed is:

1. An aspiration-type chemical sprayer adapted to be connected to a source of carrier liquid under pressure comprising:

a container having an interior for storing a chemical to be sprayed;

a sprayer head having an aspiration orifice, a carrier fluid bore for directing the carrier liquid past the aspiration orifice, an aspiration passageway for directing chemicals from the container interior to the aspiration orifice, an atmospheric vent port for communication of atmospheric pressure with the container interior and a bore located between the aspiration orifice, the aspiration passageway, the atmospheric vent port and the container interior;

connection means for mounting the sprayer head to the container;

a chemical flow tube in fluid communication between the chemical stored in the container and the aspiration passageway;

a rod valve slideably positioned within the bore, the rod valve including a pair of spaced annular integral sealing ridges molded in one piece of a plastic material, the sealing ridges arranged to seal against the interior surface of the bore to simultaneously connect the aspiration passageway to the aspiration orifice and the vent port to the interior of the container in one, open, position of the rod valve and to simultaneously disconnect the aspiration passageway from the aspiration orifice and the vent port from the interior of the container in another, closed position of the rod valve; and a carrier liquid control valve for selectively opening and closing the carrier fluid bore to the source of pressurized carrier liquid.

2. The sprayer of claim 1 wherein the carrier liquid control valve is rotatably mounted within the sprayer head so that in one rotational position the carrier liquid control valve is open to allow carrier fluid to educt chemical from the container and in another rotational position the carrier liquid control valve member is closed.

3. The sprayer of claim 2 wherein the rod valve further comprises locating means for positioning the rod valve in the open position and closed position.

4. The sprayer of claim 3 wherein the rod valve locating means includes two annular protrusions on the rod valve and a protrusion circumscribing the interior surface of the bore seated between the two annular protrusions.

5. The sprayer of claim 3 wherein the carrier liquid control valve further has a stopper means for closing the carrier fluid passageway.

6. The sprayer of claim 5 wherein the stopper means comprises a stopper member seated on the carrier liquid control valve.

7. The sprayer of claim 1 wherein ends of said rod valve do not extend beyond the ends of said bore.

8. An aspiration-type chemical sprayer adapted to be connected to a source of carrier liquid under pressure comprising:

a container having an interior for storing a chemical to be sprayed;

a sprayer head having an aspiration orifice, a carrier fluid bore for directing the carrier liquid past the aspiration orifice, an aspiration passageway for directing chemicals from the container interior to the aspiration orifice, an atmospheric vent port for communication of atmospheric pressure with the container interior and a bore located between the aspiration orifice, the aspiration passageway, the atmospheric vent port and the container interior;

connection means for mounting the sprayer head to the container;

a chemical flow tube in fluid communication between the chemical stored in the container and the aspiration passageway; and a rod valve slideably positioned within the bore, the rod valve having sealing means arranged to seal against the interior surface of the bore to simultaneously connect the aspiration passageway to the aspiration orifice and the vent port to the interior of the container in one, open, position of the rod valve and to simultaneously disconnect the aspiration passageway from the aspiration orifice and the vent port from the interior of the container in another, closed position of the rod valve, the rod valve being dimensioned so that the ends thereof do not extend beyond the ends of the bore; and a carrier liquid control valve for selectively opening and closing the carrier fluid bore to the source of pressurized carrier liquid.

9. The apparatus defined in claim 8 wherein said rod valve further comprises two rectangular shaped annular protrusions for slideably engaging the interior surface of the bore.

10. The apparatus defined in claim 9 wherein said rod valve and bore further comprise locating means for positioning said rod valve within said bore.

* * * * *

UNITED STATES PATENT AND TRADEMARK OFFICE

CERTIFICATE OF CORRECTION

PATENT NO. : 5,383,603

DATED : January 24, 1995

INVENTOR(S) : Ronald F. Englhard and Donald J. Shanklin

It is certified that error appears in the above-identified patent and that said Letters Patent is hereby corrected as shown below:

Column 6, line 30, after "valve" delete "member".

Signed and Sealed this

Twenty-fifth Day of April, 1995

*Attest:*

BRUCE LEHMAN

*Attesting Officer*

*Commissioner of Patents and Trademarks*